US008252078B2

(12) United States Patent
Mun et al.

(10) Patent No.: US 8,252,078 B2
(45) **Date of Patent: *Aug. 28, 2012**

(54) CEILING TYPE AIR CONDITIONER

(75) Inventors: Seong Kuk Mun, Changwon-si (KR); Dong Myeong Choi, Changwon-si (KR)

(73) Assignee: LG Electronics Inc., Seoul (KR)

( * ) Notice: Subject to any disclaimer, the term of this patent is extended or adjusted under 35 U.S.C. 154(b) by 293 days.

This patent is subject to a terminal disclaimer.

(21) Appl. No.: 12/219,552

(22) Filed: Jul. 23, 2008

(65) Prior Publication Data

US 2009/0193769 A1 Aug. 6, 2009

(30) Foreign Application Priority Data

Feb. 4, 2008 (KR) ..... 10-2008-0011214

(51) Int. Cl.
*B01D 46/00* (2006.01)

(52) U.S. Cl. ..... 55/283; 55/289; 55/295; 55/296

(58) Field of Classification Search ..... 55/289, 55/283, 284, 295–300; 165/4–10, 95, 303, 165/DIG. 10, DIG. 11, DIG. 85; 62/303–316
See application file for complete search history.

(56) References Cited

U.S. PATENT DOCUMENTS

| | | | | | |
|---|---|---|---|---|---|
| 3,221,479 | A * | 12/1965 | Moser et al. | 55/296 |
| 3,926,063 | A * | 12/1975 | Mayfield | 474/132 |
| 4,964,891 | A * | 10/1990 | Schaefer | 65/377 |
| 5,626,517 | A * | 5/1997 | Kil | 454/315 |
| 5,922,092 | A * | 7/1999 | Taylor | 55/295 |
| 6,244,954 | B1 * | 6/2001 | Hosokawa et al. | 454/315 |
| 6,338,382 | B1 * | 1/2002 | Takahashi et al. | 165/96 |
| 6,451,093 | B1 * | 9/2002 | Miles | 95/270 |
| 6,729,154 | B2 * | 5/2004 | Takashima et al. | 62/317 |
| 6,786,061 | B2 * | 9/2004 | Asami et al. | 62/263 |
| 7,186,281 | B2 * | 3/2007 | Cheng | 55/289 |
| 7,314,495 | B2 * | 1/2008 | Dullien et al. | 55/308 |
| 7,350,371 | B2 * | 4/2008 | Lee et al. | 62/317 |
| 7,827,810 | B2 * | 11/2010 | Hur et al. | 62/126 |
| 2006/0070358 | A1 * | 4/2006 | Oda et al. | 55/295 |
| 2007/0060036 | A1 * | 3/2007 | Shibuya et al. | 454/187 |
| 2010/0116463 | A1 * | 5/2010 | Zhang et al. | 165/95 |

FOREIGN PATENT DOCUMENTS

| | | | |
|---|---|---|---|
| CN | 201007526 | Y | 1/2008 |
| EP | 1 988 342 | A1 | 11/2008 |
| GB | 2463857 | | 3/2010 |
| JP | 2007-271174 | | 10/2007 |
| WO | WO 2008/096532 | A1 | 8/2008 |
| WO | WO 2008/096536 | A1 | 8/2008 |

* cited by examiner

*Primary Examiner* — Duane Smith
*Assistant Examiner* — Thomas McKenzie
(74) *Attorney, Agent, or Firm* — McKenna Long & Aldridge LLP

(57) ABSTRACT

There is provided a ceiling type air conditioner including a brush assembly for collecting foreign matters filtered by a filter. The brush assembly includes a brush that contacts the foreign matters filtered by the filter and a main body for collecting the foreign matters separated from the filter to store the foreign matters. Therefore, it is possible to effectively collect and store the foreign matters filtered by the filter in the main body due to the movement of the brush assembly. In addition, since a user does not have to exchange or clean the filter, it is possible to prevent inconvenience from being caused by exchanging or cleaning the filter and to prevent the filter from being contaminated.

13 Claims, 13 Drawing Sheets

CEILING TYPE AIR CONDITIONER

This non-provisional application claims priority under 35 U.S.C. §119(a) on Patent Application No. 10-2008-0011214 filed in Republic of Korea on Feb. 4, 2008, the entire contents of which are hereby incorporated by reference.

BACKGROUND OF THE INVENTION

1. Field of the Invention

The present invention relates to a ceiling type air conditioner, and more particularly, to a ceiling type air conditioner capable of collecting filtered foreign matters to store the collected foreign matters.

2. Discussion of the Related Art

Generally, a ceiling type air conditioner includes an indoor unit provided on a ceiling to perform a cooling function, an outdoor unit for performing heat radiation and compression functions, and a refrigerant tube for connecting the indoor unit and the outdoor unit to each other. The indoor unit is provided in an internal space on a ceiling.

However, in a conventional ceiling type air conditioner, the foreign matters of the air introduced to the indoor unit are accumulated on the indoor unit so that the components in the indoor unit are not sufficiently protected and that the air in a room to be air conditioned is contaminated.

Furthermore, when the foreign matters in the air suctioned into the ceiling type air conditioner are filtered, the amount of the foreign matters collected by a filter increases so that the flow of the air that passes through the indoor unit is prohibited to deteriorate the function of the ceiling type air conditioner. Since the filter is to be detachably installed in order to exchange and clean the filter, the installation position of the filter, the installation method of the filter, and the layout of the components around the filter are limited. In addition, since a user must exchange and clean the filter, due to the inconvenience caused by exchanging and cleaning the filter and the unpleasant feeling caused by the contamination of the filter, sensitivity quality deteriorates.

SUMMARY OF THE INVENTION

It is an object of the present invention to provide a ceiling type air conditioner capable of collecting foreign matters filtered by a filter to store the collected foreign matters.

A ceiling type air conditioner according to the present invention comprises a case that is provided on a ceiling and in which a predetermined space is formed, a base panel that is coupled to the case and on whose one side air suctioning hole is formed, a filter provided in the air suctioning hole, and a brush assembly for collecting foreign matters filtered by the filter. The brush assembly comprises a brush that is provided under the filter to contact the foreign matters filtered by the filter and a main body that contacts the brush to form a predetermined space in which the foreign matters that drop from the filter in a gravitational direction are collected and stored.

The brush assembly includes a brush that contacts the foreign matters filtered by the filter and a main body for collecting the foreign matters separated from the filter to store the foreign matters. Therefore, it is possible to effectively collect and store the foreign matters filtered by the filter in the main body due to the movement of the brush assembly. In addition, since a user does not have to exchange or clean the filter, it is possible to prevent inconvenience from being caused by exchanging or cleaning the filter and to prevent the filter from being contaminated.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Hereinafter, embodiments of a ceiling type air conditioner according to the present invention will be described in detail with reference to the accompanying drawings.

Figure 1:
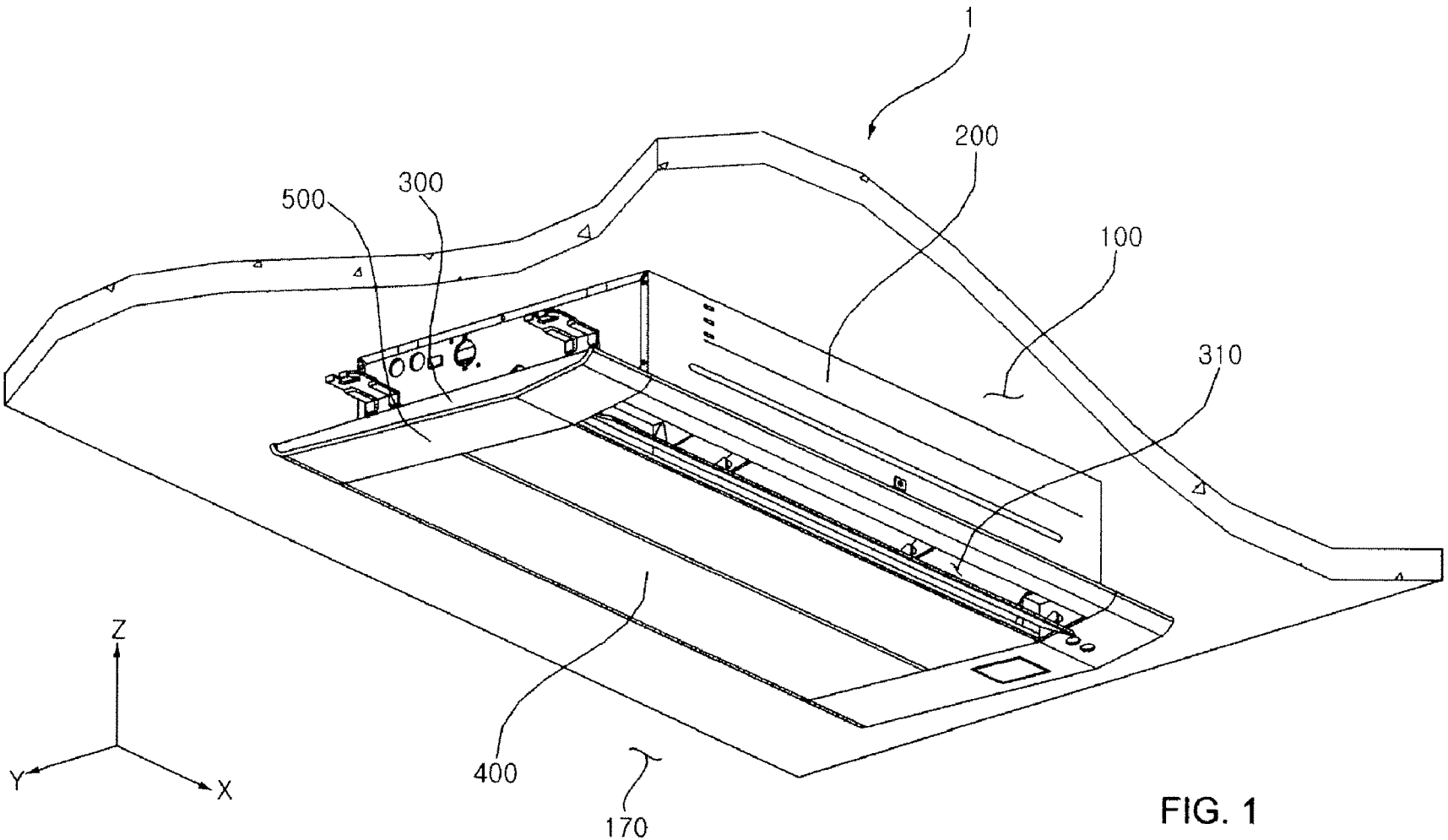
FIG. 1 is a perspective view illustrating a ceiling type air conditioner according to the present invention.
Figure 2:
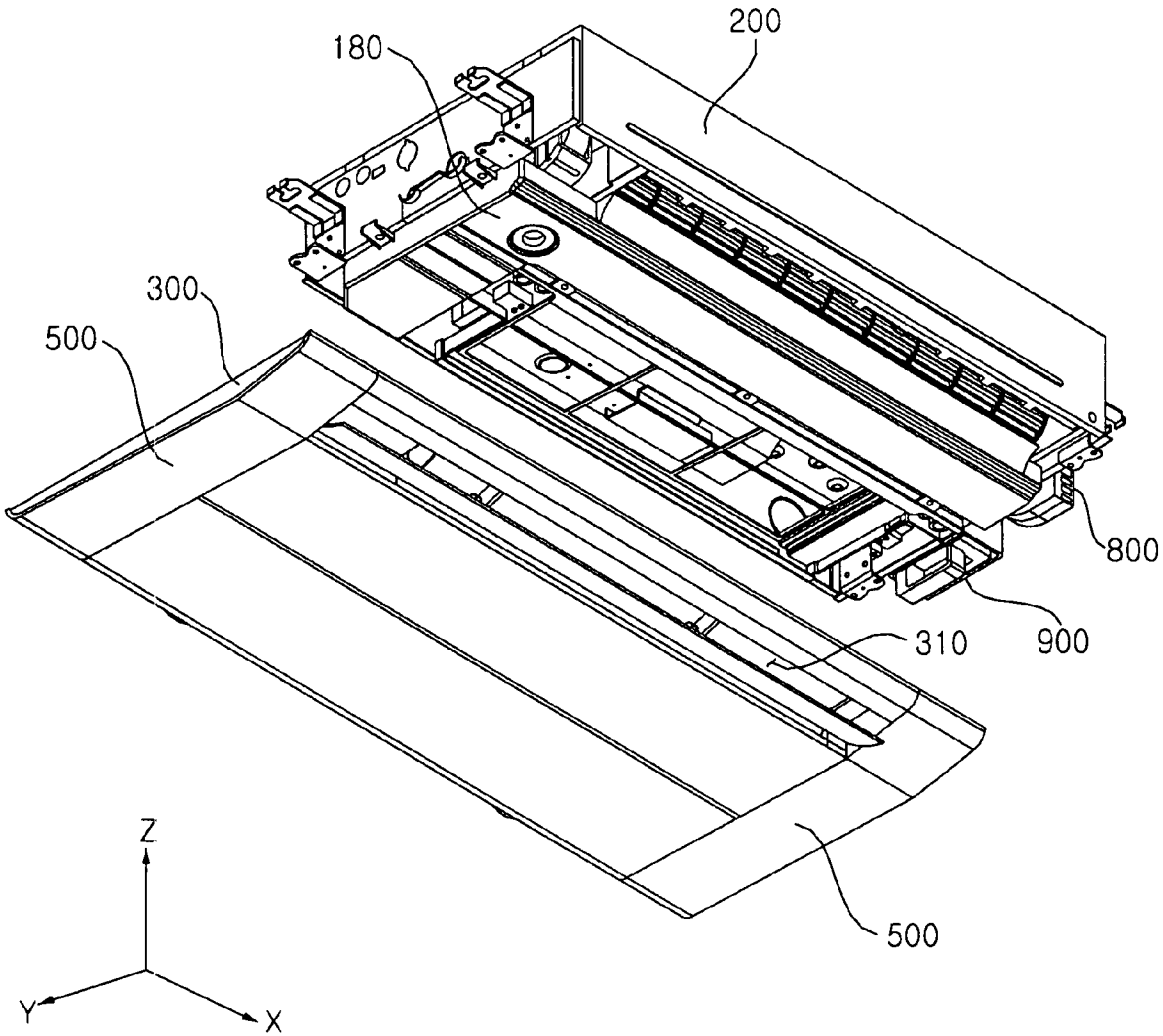
FIG. 2 is a perspective view illustrating a state in which a base panel is separated from the case illustrated in FIG. 1.

FIG. 1 is a perspective view illustrating a ceiling type air conditioner 1 according to the present invention. FIG. 2 is a perspective view illustrating a state in which a base panel 300 is separated from the case 200 illustrated in FIG. 1.

Hereinafter, for convenience sake, in FIGS. 1 and 2, the longitudinal direction, that is, the right-to-left direction of the case 200 is denoted by reference numeral X, a direction horizontally orthogonal to the longitudinal direction of the case 200, that is, a front-to-rear direction is denoted by reference numeral Y, and a direction orthogonal to the longitudinal direction of the case 200, that is, an up-to-down direction is denoted by reference numeral Z.

Referring to FIGS. 1 and 2, the ceiling type air conditioner 1 according to the present invention includes the case 200 fixed to the internal space of the ceiling 100 to suction the air and to discharge the heat-exchanged air. The case 200 can be a rectangular parallelepiped whose bottom is opened and whose longitudinal sides are longer than the other sides.

The case 200 is fixed by fastening tools such as a bolt (not shown) to be closely attached to the ceiling 100. Various heat-exchanging components 180 for suctioning the air in a lower space 170 to perform heat-exchange and to discharge the heat-exchanged air are provided in the case 200. The ceiling type air conditioner 1 further includes a base panel 300 coupled to the bottom of the case 200 to cover the opened bottom of the case 200.

A front panel 400 for opening and closing an air suctioning hole 305 is provided on the bottom of the base panel 300. The front panel 400 opens the air suctioning hole 305 formed in the base panel 300 to guide the suctioned air to the case 200 when the air conditioner operates and closes the air suctioning hole 305 to form the external appearance of the bottom of the ceiling 100 when the air conditioner does not operate.

The ceiling air conditioner 1 further includes side panels 500 provided on the base panel 300 corresponding to at least one side of the front panel 400. The side panels 500 can be coupled to the base panel 300 so that a user can selectively attach the side panels 500 to the base panel 300 and detach the side panels 500 from the base panel 300. The side panels 500 are provided on the bottom of the base panel 300 to form a part of the external appearance of the air conditioner 1.

Figure 3:
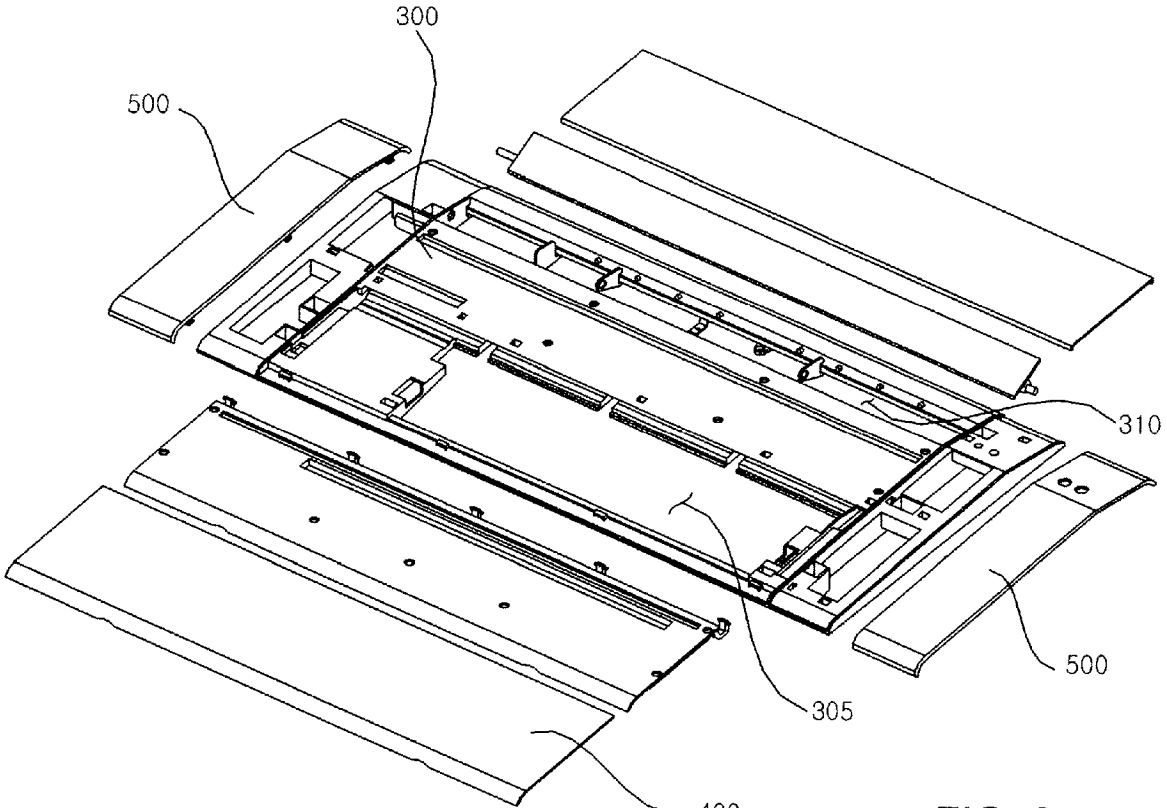
FIG. 3 is an exploded perspective view illustrating components coupled to the base panel illustrated in FIG. 1.

FIG. 3 is an exploded perspective view illustrating components coupled to the base panel illustrated in FIG. 1. Referring to FIG. 3, the air suctioning hole 305 for having the inside communicate with the outside of the case 200 is longitudinally formed in the base panel 300 in an X-direction and an air discharging hole 310 for having the inside communicate with the outside of the case 200 is formed in a position separated from the air suctioning hole 305 by a predetermined distance in an Y-direction to run parallel with the air suctioning hole 305. The air suctioning plane of the air suctioning hole 305 and the air discharging plane of the air discharging hole 310 can be provided to be actually parallel with respect to a horizontal plane.

Figure 4:
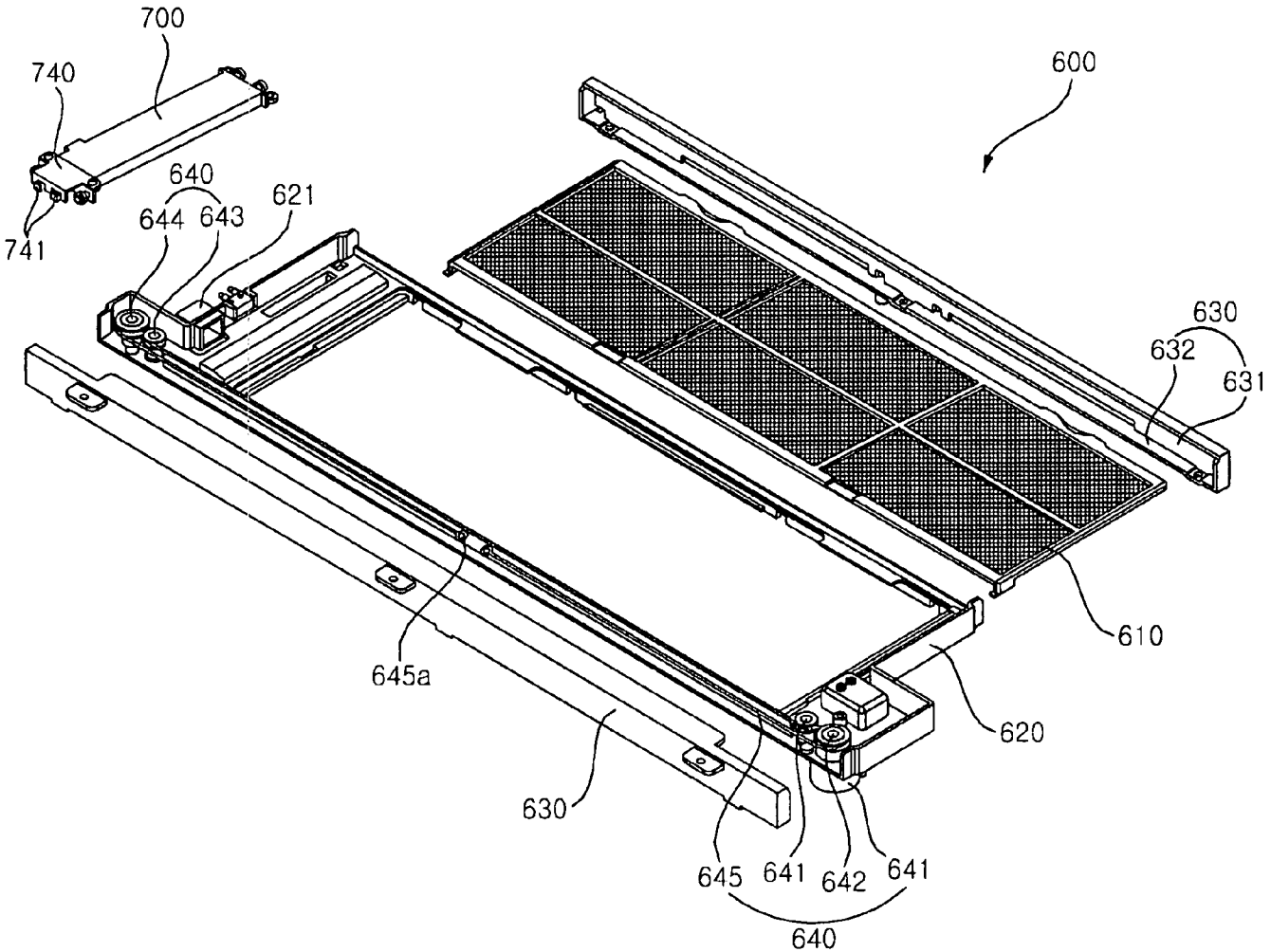
FIG. 4 is an exploded perspective view illustrating a cleaning device coupled to the air suctioning hole of the base panel illustrated in FIG. 1.
Figure 5:
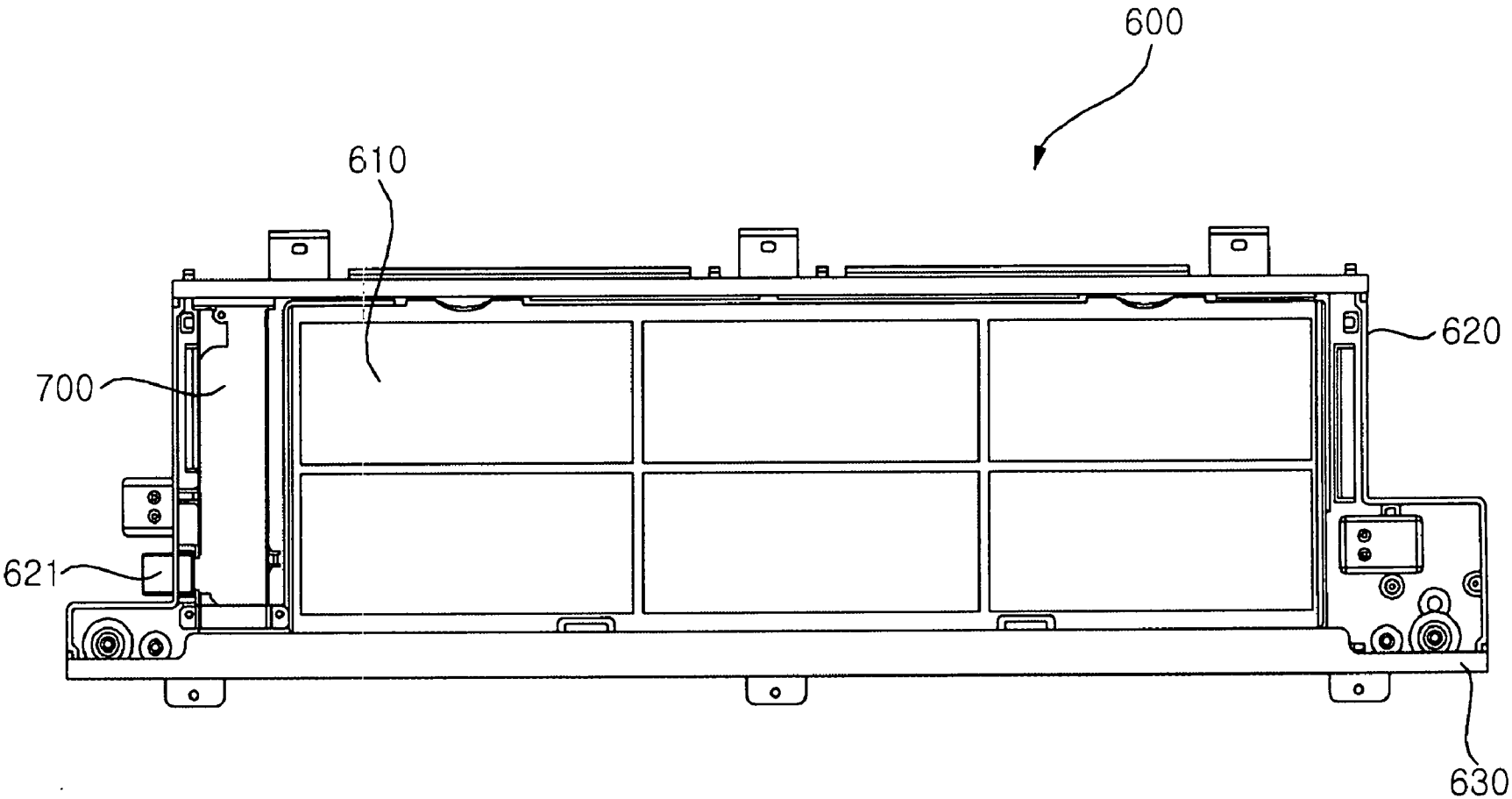
FIG. 5 is a perspective view illustrating the assembly of the cleaning device illustrated in FIG. 4.
Figure 6:
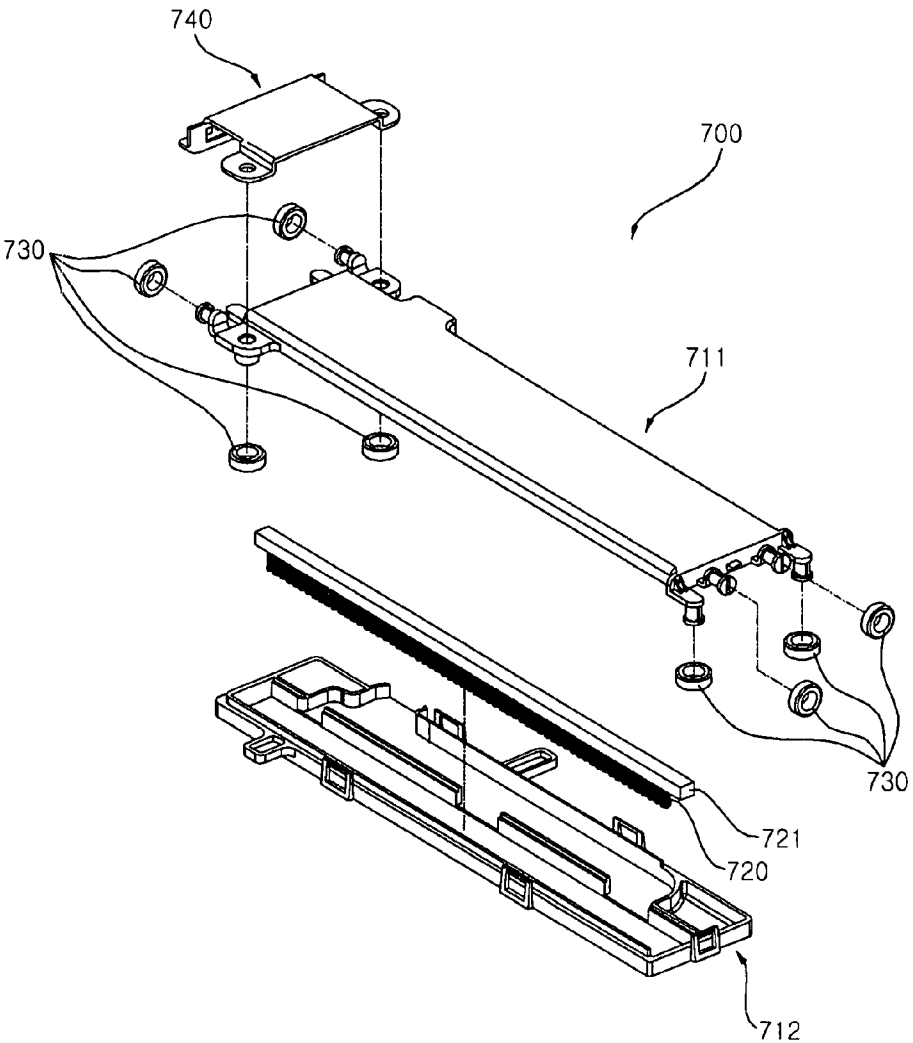
FIG. 6 is an exploded perspective view of the brush assembly illustrated in FIG. 4.

FIG. 4 is an exploded perspective view illustrating a cleaning device 600 coupled to the air suctioning hole 305 of the base panel 300 illustrated in FIG. 1. FIG. 5 is a perspective view illustrating the assembly of the cleaning device 600 illustrated in FIG. 4. FIG. 6 is an exploded perspective view of the brush assembly 700 illustrated in FIG. 4.

The cleaning device 600 according to the present invention includes a filter 610, a filter housing 620 in which the filter 610 is mounted, and a brush assembly 700.

First, the filter 610 for filtering foreign matters in the air introduced through the air suctioning hole 305 is provided in the air suctioning hole 305. As illustrated in FIG. 4, the filter 610 is settled in the filter housing 620 provided in the air suctioning hole 305. The filter 610 can be attached to and detached from the filter housing 620 so that the user can exchange the filter 610. Therefore, the filter 610 can be fitted into or can slide to be coupled to the filter housing 620. However, the present invention is not limited to the above.

The filter 610 and the filter housing 620 are manufactured based on the size of the air suctioning hole 305 to be coupled to the air suctioning hole 305 by the above-described fitting or sliding method. However, the present invention is not limited to the above. Since the filter 610 collects the foreign matters in the air suctioned through the air suctioning hole 305, the amount of the foreign matters collected by the filter 610 increases with the lapse of time for which the filter 610 is used.

Referring to FIGS. 4 and 5, the brush assembly 700 is coupled to the filter housing 620 and is provided under the filter 610. Referring to FIG. 6, the brush assembly 700 includes a brush 720 and a main body 710.

The main body 710 contacts the brush 720 to form a predetermined space in which the foreign matters separated from the filter 610 are collected and stored. To be specific, the main body 710 includes a main body base 71-1 that forms the bottom of the main body 710 and a main body cover 712 for covering the main body base 711.

At least one supporting units (722 of FIG. 8 to be described later) protrude on the bottom of the main body base 711 and a brush frame 721 is coupled onto the supporting units 722.

The brush 720 is fixed to the brush frame 721 provided in the main body 710. The brush 720 is provided under the filter 610 to contact the foreign matters filtered by the filter 610 and drop the foreign matters in a gravitational direction.

Since the brush 720 contacts the filter 610, the foreign matters filtered by the filter 610 drop in the gravitational direction to be stored in the main body base 711.

To be specific, the brush 720 is provided under the filter 610 and moving unit 640 and the brush assembly 700 are connected to each other. The brush assembly 700 can be moved by the moving unit 640 in one direction of the filter housing 620. When the brush assembly 700 moves in one direction (the X-direction of FIG. 1) of the filter housing 620, the brush 720 contacts the filter 610. Since the brush 720 contacts the filter 610, the foreign matters separated from the filter 610 drop in the gravitational direction to be accumulated on the main body 710.

Referring to FIG. 6, the brush assembly 700 further includes a plurality of rollers 730 provided between the filter housing 620 and the main body 710. When the brush assembly 700 is moved by the moving unit 640, the rollers 730 roll along one side of the filter housing and the brush assembly 700 moves based on the rolling operation.

Referring to FIG. 4, the filter housing 620 includes movement 10. guiding units 630 for supporting both sides of the main body 710 to guide the movement of the brush assembly 700 and to prevent the main body 710 from being separated downward on at least one sides of the filter housing 620.

Figure 7:
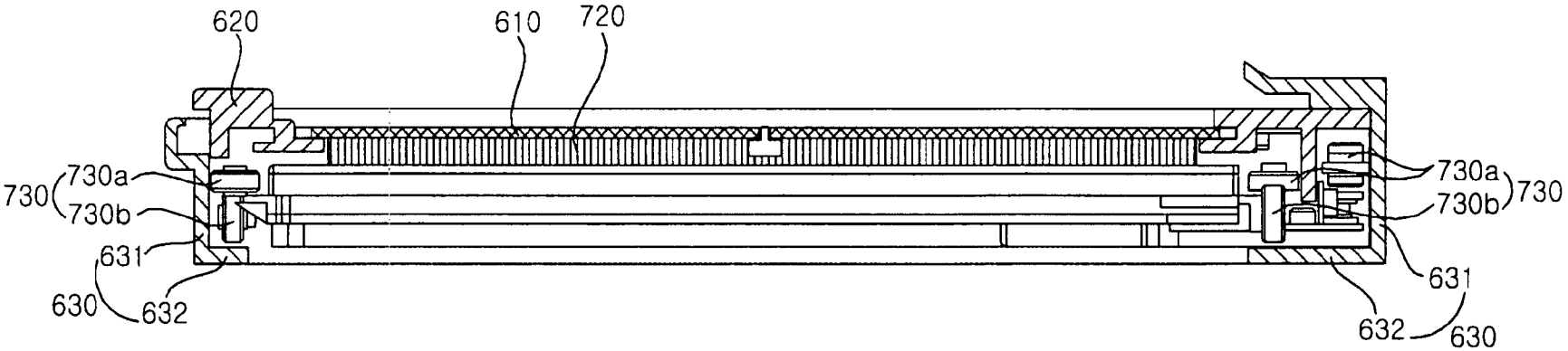
FIG. 7 is a side view illustrating the cleaning device illustrated in FIG. 4.

FIG. 7 is a side view illustrating the cleaning device 600 illustrated in FIG. 4. Referring to FIGS. 4 and 7, the movement guiding units 630 include supporting surfaces 631 extended downward from both ends parallel with the longitudinal direction of the filter housing 620 to support both ends of the brush assembly 700 in the longitudinal direction of the brush assembly 700 and separation preventing surfaces 632 extended from the ends of the supporting surfaces 631 to run parallel with the filter housing 620 to prevent the brush assembly 700 from being separated downward.

The movement guiding units 630 are provided at least on one sides of the filter housing 620. As illustrated in FIG. 7, the movement guiding units 630 can be provided on both sides of the filter housing 620 to support both ends of the brush assembly 700.

The plurality of rollers 730 are provided in the movement guiding units 630 to roll. To be specific, the plurality of rollers 730 are provided on both ends of the brush assembly 700 and include horizontal rollers **730*a* and vertical rollers 730*b* in each end. The horizontal rollers 730*a* prevent the brush assembly 700 from being separated in a lateral direction and the vertical rollers 730*b* prevent the brush assembly 700** from being separated in a vertical direction.

To be specific, the horizontal rollers **730*a* are provided to support and to be supported by the supporting surfaces 631 to roll and the vertical rollers 730*b* are provided to support and to be supported by the separation preventing surfaces 632 to roll. The brush assembly 700 is supported by the plurality of rollers 730 in the horizontal direction and the vertical direction. At the same time, when the brush assembly 700 moves along one direction (the X-direction of FIG. 1) of the filter housing 620**, a twisting or shaking phenomenon in the horizontal or vertical direction can be prevented.

On the other hand, the cleaning device 600 according to the present invention further includes the moving unit 640 for moving the brush assembly 700.

The moving unit 640 moves the brush assembly 700 along one direction (the X direction of FIG. 1) of the filter housing 620. To be specific, the movable unit 640 includes a driving motor 641 provided on at least one side of the filter housing 620 and a power transmitting unit coupled to the brush assembly 700 to transmit the power of the driving motor 641 to the brush assembly 700. Therefore, the brush assembly 700 is coupled to the filter housing 620 to be moved by the power transmitting unit in one direction of the filter housing 620.

The power transmitting unit includes a driving pulley 642, a driven pulley 644, a tension pulley 643, and a wire belt 645.

The driving pulley 642 is connected to the rotary shaft of the driving motor 641. When the rotary shaft of the driving motor 641 is rotated by a power source applied from a power supply (not shown), the driving pulley 642 is driven to rotate. The driven pulley 644 is provided on the other side of the filter housing 620 in which the driving pulley 642 is provided.

The wire belt 645 is wound around the driving pulley 642 and is connected to the brush assembly 700 to transmit the driving force of the driving motor 641 to the brush assembly 700. The brush assembly 700 is connected to the wire belt 645 as follows.

Referring to FIG. 4, a wire connecting unit 740 to which the wire belt 645 is connected is formed on one side of the brush assembly 700 and fixing units 741 are formed in the wire connecting unit 740. Rings 645*a* are formed in one end and the other end of the wire belt 645 and the rings 645*a* are locked to the fixing units 741 of the wire connecting unit 740. Here, the fixing units 741 are preferably hook-shaped so that the wire belt 645 can be easily attached and detached. In addition, the wire belt 645 can be formed of an elastic material in order to increase contacting force between the driving pulley 642 and the tension pulley 643 or between the driving pulley 644 and the tension pulley 643 or between the driven pulley 644 and the tension pulley 643.

The tension pulley 643 is provided on the traveling path of the wire belt 645 to be separated from the driving pulley 642 and the driven pulley 644 so that the wire belt 645 is wound on one side to generate tension in the wire belt 645.

On the other hand, the plurality of rollers 730 are provided in the movement guiding units 630 to be rolled by the power transmitted from the power transmitting unit. That is, when the power of the driving motor 641 is transmitted to the wire belt 645, the wire belt 645 rotates and is wound so that the rollers 730 of the brush assembly 700 roll along the supporting surfaces 631 and the separation preventing surfaces 632 of the movement guiding units 630.

Figure 8:
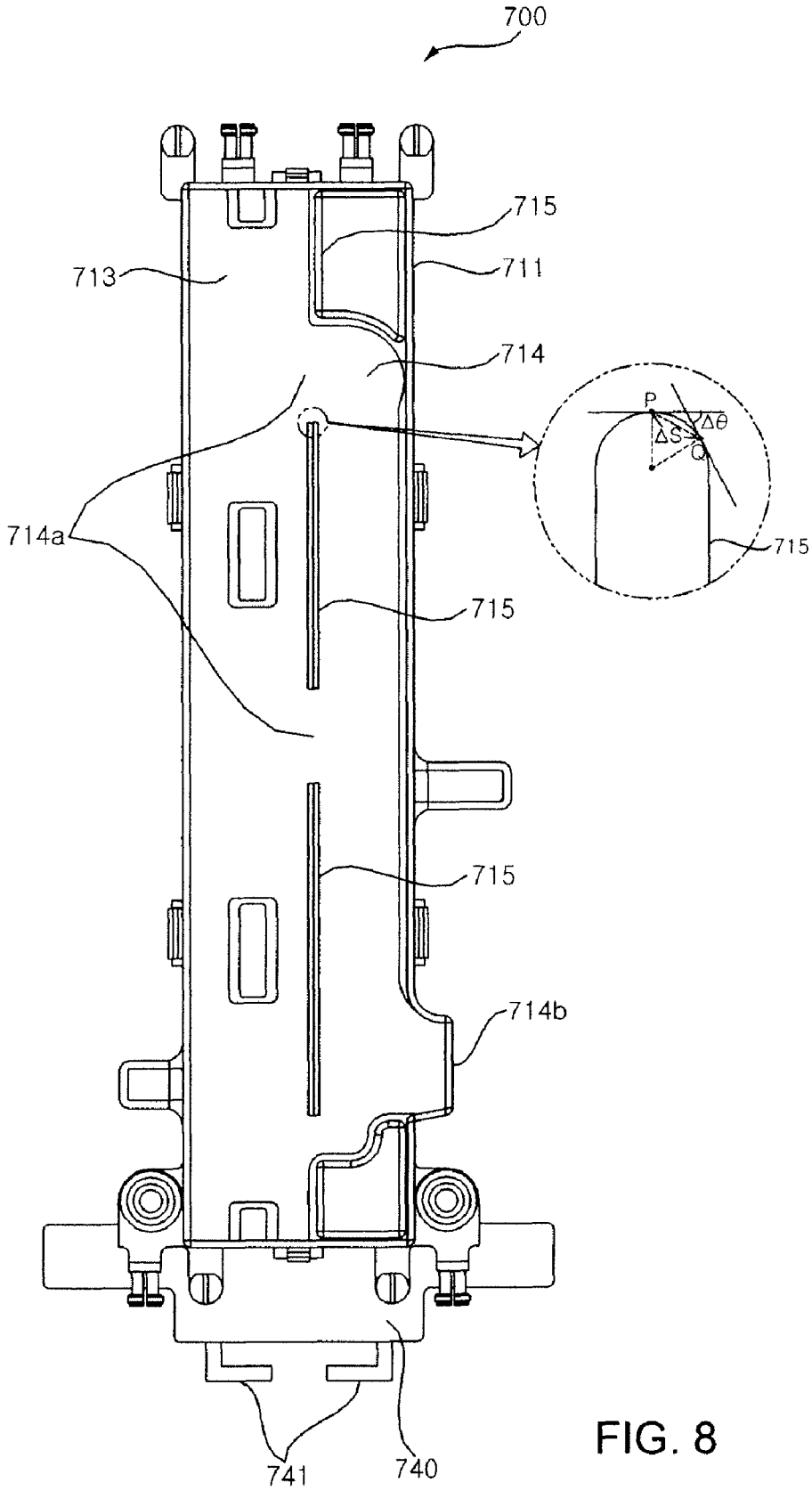
FIG. 8 is a plan view of the brush assembly illustrated in FIG. 4.
Figure 9:
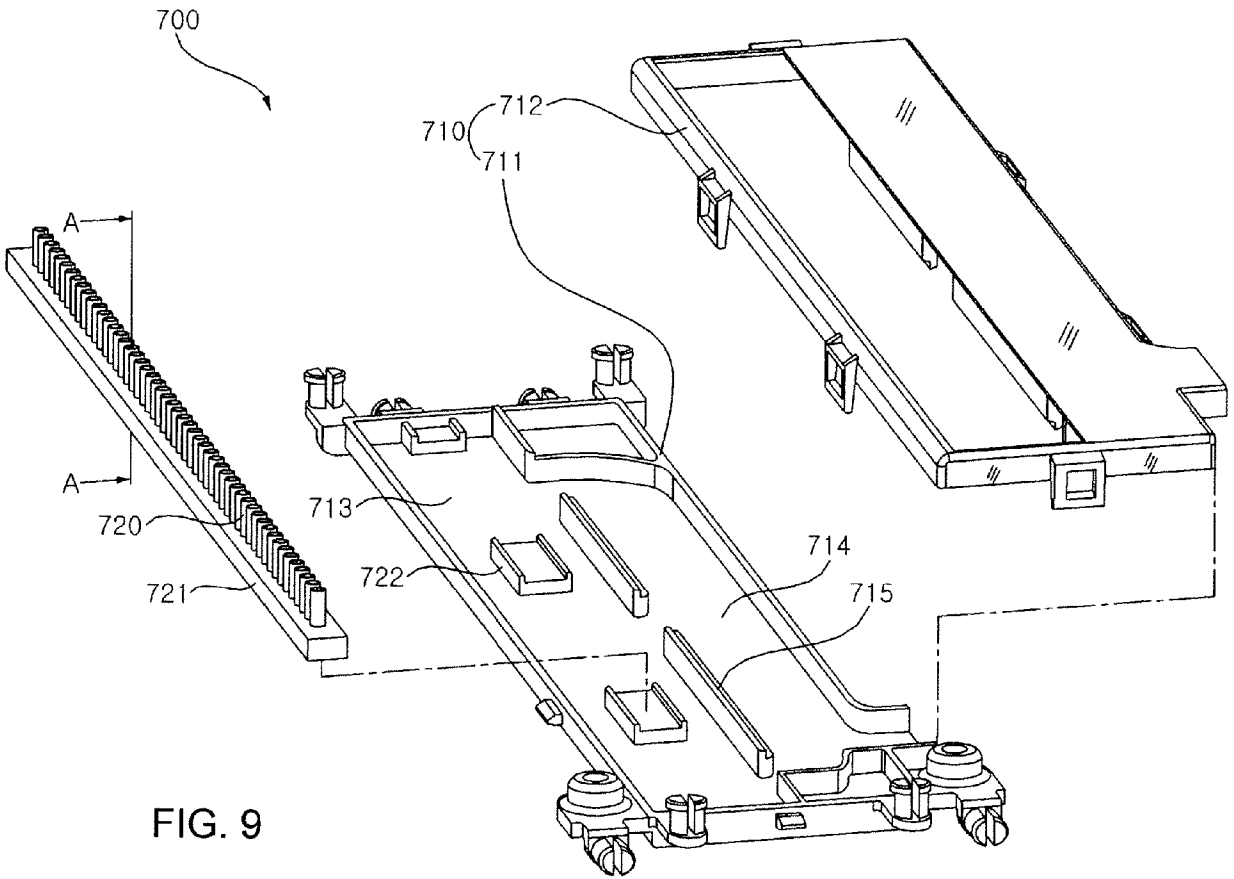
FIG. 9 is an exploded perspective view of the brush assembly illustrating the inside of the main body of the brush assembly illustrated in FIG. 4.

FIG. 8 is a plan view of the brush assembly illustrated in FIG. 4. FIG. 9 is an exploded perspective view of the brush assembly illustrating the inside of the main body of the brush assembly illustrated in FIG. 4.

As described above, the wire connecting unit 740 to which the wire belt 645 is connected is formed on one side of the brush assembly 700. The fixing units 741 to which both ends of the wire belt 645 are locked are formed in the wire connecting unit 740 and the fixing units 741 are hook-shaped. The rings (645*a* of FIG. 4) are formed in one end and the other end of the wire belt 645 and the rings 645*a* are locked to the fixing units 741 of the wire connecting unit 740.

The inside of the main body 710 is partitioned off into a settling unit 713 in which the foreign matters drop in the gravitational direction to be settled and a guiding unit 714 for guiding the foreign matters settled in the settling unit 713 to the outside of the main body 710. Here, at least one partitions 715 for partitioning off the inside of the main body 710 into the settling unit 713 and the guiding unit 714 are formed and suctioning holes 714*a* are formed between the partitions 715.

At this time, one end of the partitioning wall 715 can be rounded by a predetermined radius of curvature. Referring to FIG. 8, one end of the partition 715 is enlarged. One end of the partition 715 is formed to be rounded by a predetermined radius of curvature so that the resistance against the movement of the foreign matters between the settling unit 713 and the guiding unit 714 can be reduced. Here, in a case where a minute traveling distance when two arbitrary points P on one end of the partition 715 move to an arbitrary point Q is $\Delta S$ and an angle formed by two tangent lines in the two points P and Q is $\Delta\theta$, the radius of curvature means the rate of change of $\Delta\theta$ to $\Delta S$. When one end of the partition 715 is rounded to reduce the resistance against the movement of the foreign matters between the partitions 715 is reduced, while a suctioning unit 800 to be described later operates, it is possible to prevent the foreign matters from being accumulated on the settling unit 713.

Here, the brush frame 721 is provided on the settling unit 713 and the width of the brush frame 721 is smaller than the width of the settling unit 713. After the brush 720 fixed to the brush frame 721 contacts the filter 610, in a case where the foreign matters drop in the gravitational direction, when the width of the brush frame 721 is larger than the width of the settling unit 713, the foreign matters are not settled in the settling unit 713 but are accumulated on the brush frame 721.

On the other hand, on one side of the guiding unit 714, a discharging hole 714*b* is formed to discharge the foreign matters settled in the settling unit 713 to the outside of the main body 710. Therefore, the foreign matters accumulated on the settling unit 713 can be discharged to the outside of the main body 710 through the guiding unit 714 and the discharging hole 714*b*.

The main body base 711 and the main body cover 712 are fitted into each other. The main body cover 712 does not cover the entire surface of the main body base 711 but covers only the guiding unit 714. This is because the settling unit 713 is to be exposed to the outside in order to have the foreign matters drop from the filter 610 by the brush 720 and settled and to have the brush 720 and the brush frame 721 provided.

The cleaning device 600 according to the present invention further includes the suctioning unit 800 for suctioning the foreign matters collected by the brush assembly 700.

As illustrated in FIG. 2, the suctioning unit 800 is provided outside the case 200. When the brush assembly 700 is moved by the moving unit 640 to one end of the filter housing 620, the brush assembly 700 and the suctioning unit 800 communicate with each other.

The suctioning unit 800 includes a suction force generating unit (not shown) for generating suction force suctioning the foreign matters collected by the brush assembly 700 and a foreign matter collecting unit (not shown) for suctioning the foreign matters from the brush assembly 700 by the suction force generated by the suction force generating unit.

Referring to FIGS. 4 and 8, when the brush assembly 700 is moved by the moving unit 640 to one end of the filter housing 620, the discharging unit 714*b* formed in the guiding unit 714 of the main body 710 and a housing discharging unit 621 formed in the filter housing 620 are connected to each other. The housing discharging hole 621 and the suctioning hole (not shown) formed in the foreign matter collecting unit communicate with each other so that the brush assembly 700 and the suctioning unit 800 can communicate with each other. The housing discharging hole (not shown) and the suctioning hole (not shown) formed in the foreign matter collecting unit are directly coupled to each other to communicate with each other, however, can communicate with each other using a hose (not shown).

When the foreign matter collecting unit and the guiding unit 714 communicate with each other, the foreign matters are suctioned by the suction force generated by the suction force generating unit into the foreign matter collecting unit through the settling unit 713 and the guiding unit 714. The dust suctioned into the foreign matter collecting unit is centrifuged to be collected by and stored in a foreign matter collecting unit 900.

Figure 10:
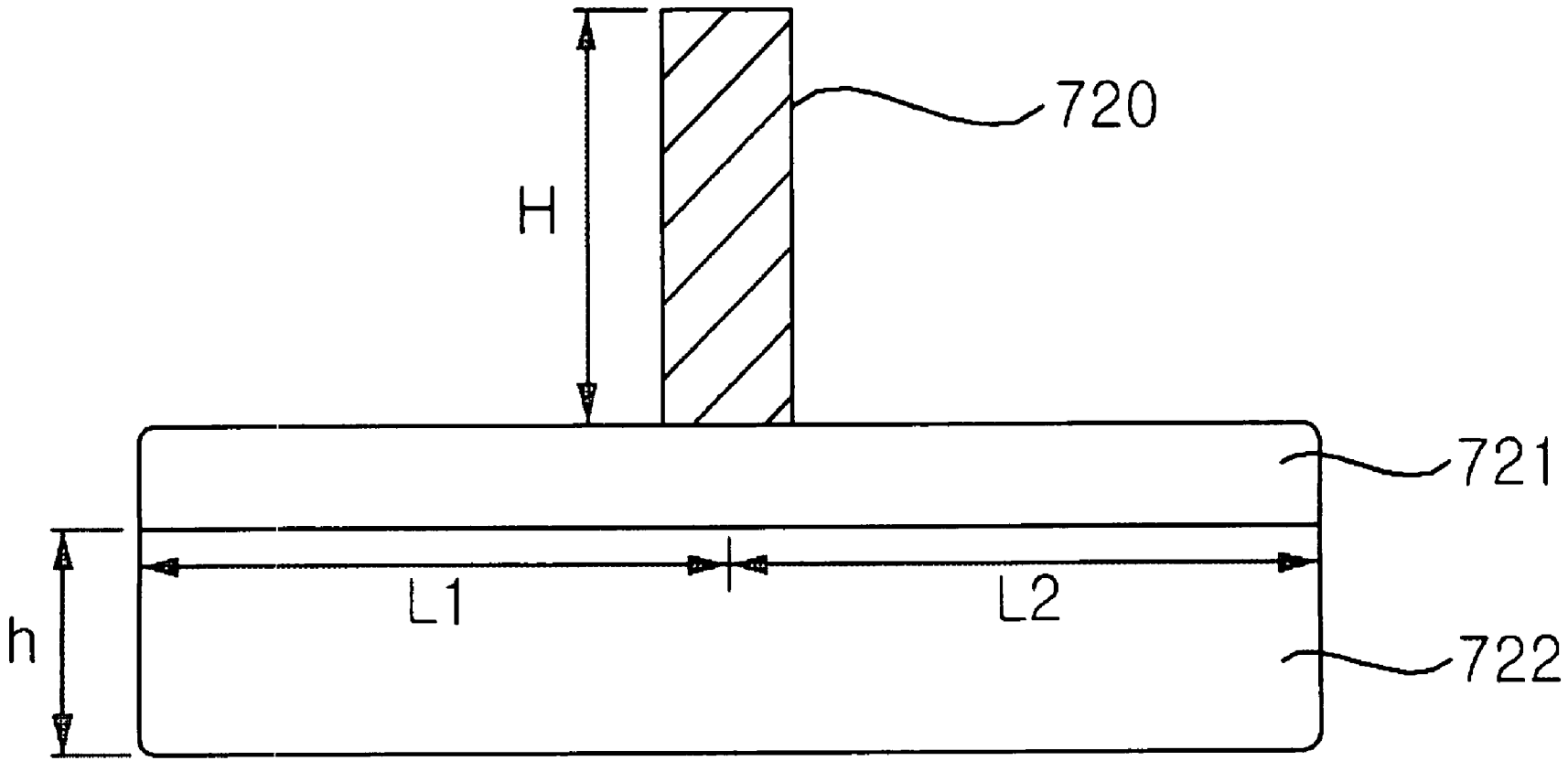
FIG. 10 illustrates a coupling structure of the brush frame illustrated in FIG. 9 according to a first embodiment.
Figure 11:
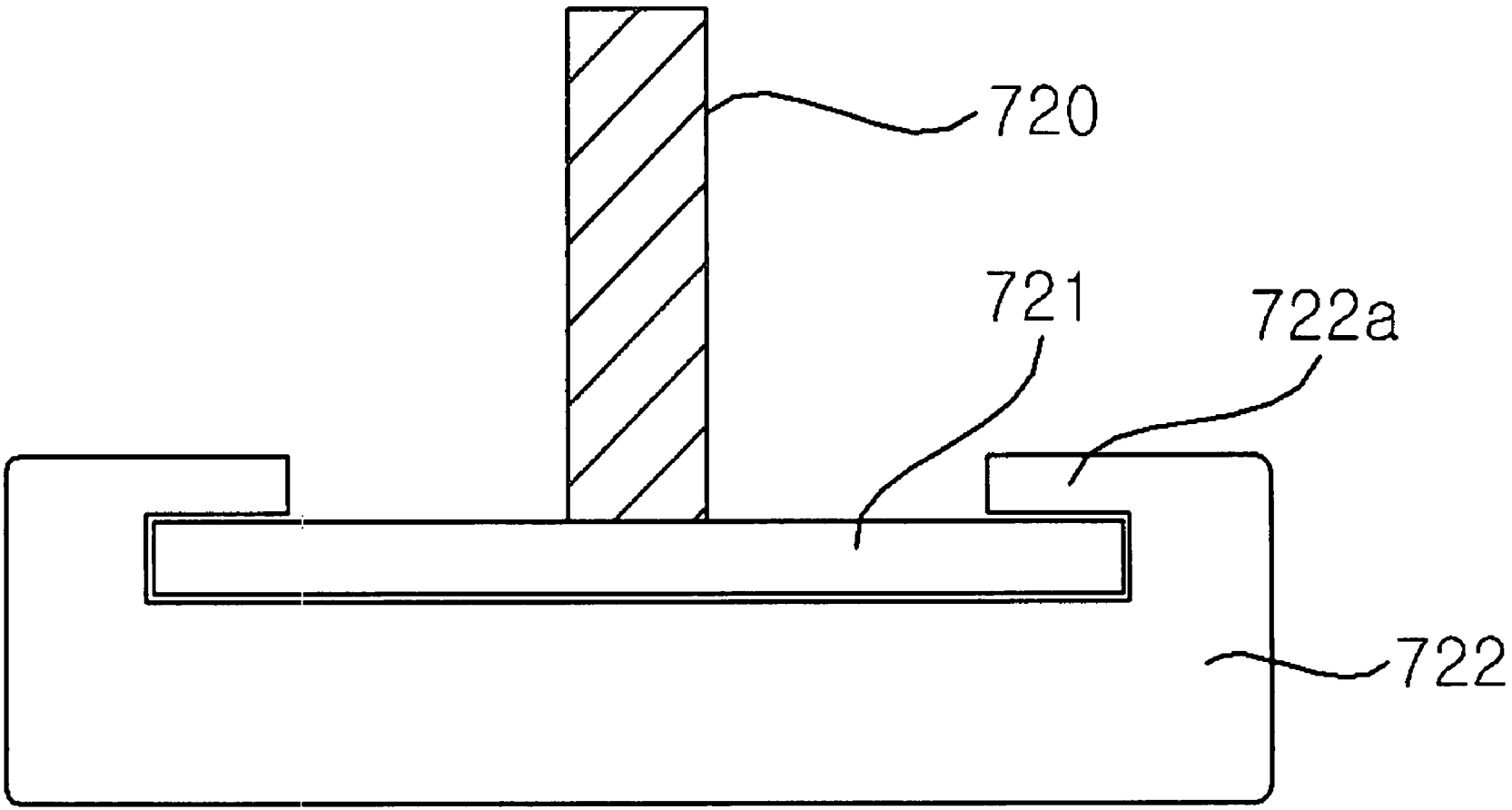
FIG. 11 illustrates a coupling structure of the brush frame illustrated in FIG. 9 according to a second embodiment.
Figure 12:
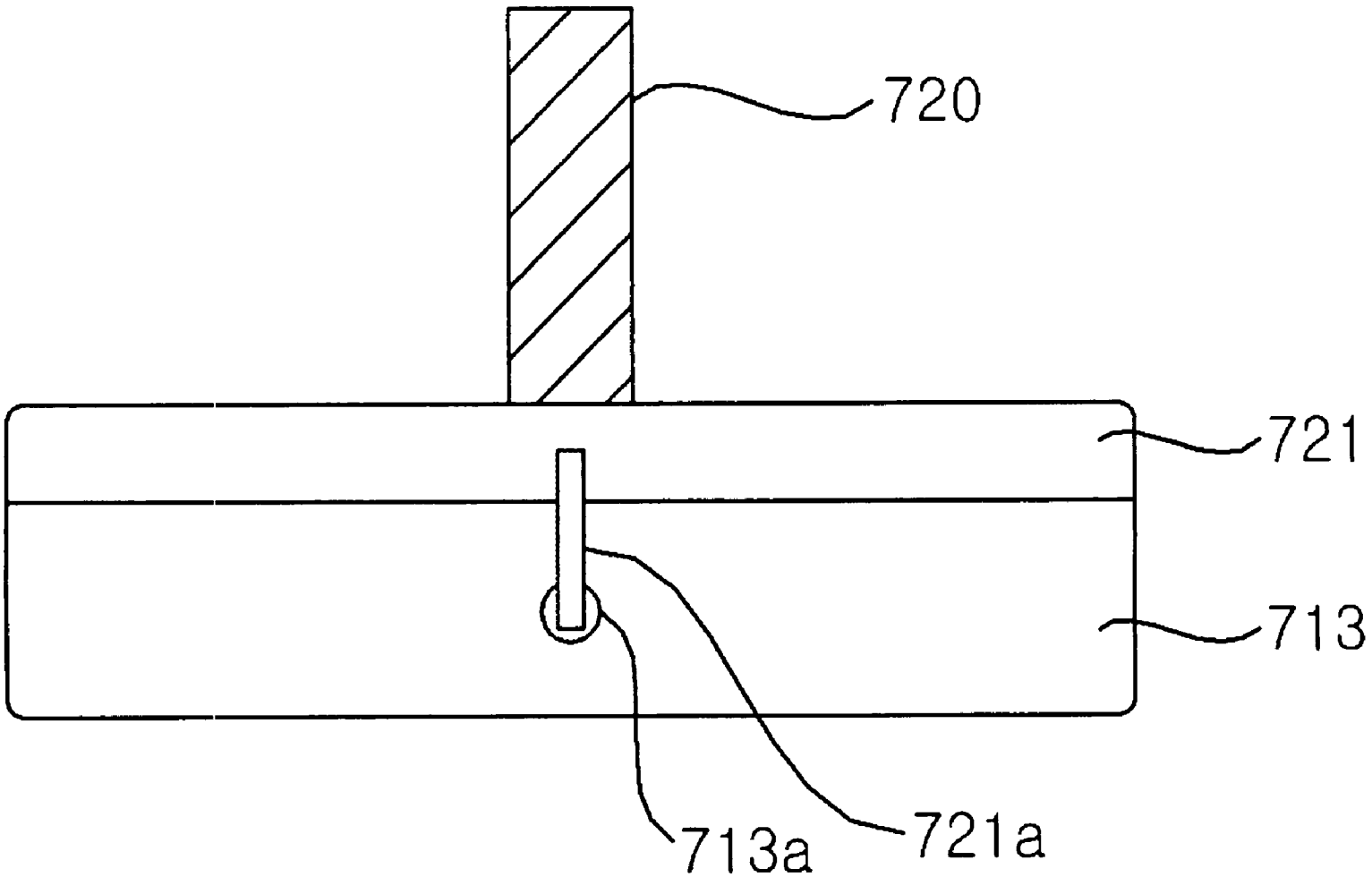
FIG. 12 illustrates a coupling structure of the brush frame illustrated in FIG. 9 according to a third embodiment.
Figure 13:
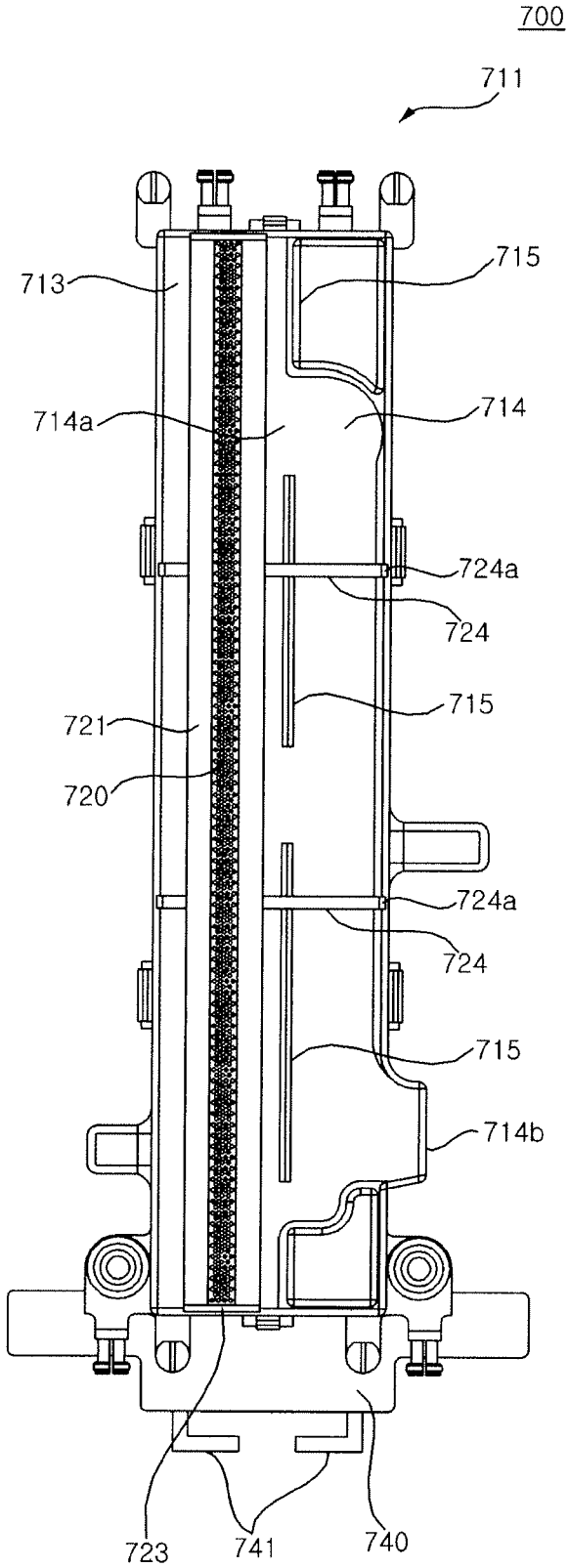
FIG. 13 illustrates a coupling structure of the brush frame illustrated in FIG. 9 according to a fourth embodiment.

FIG. 10 illustrates a coupling structure of the brush frame illustrated in FIG. 9 according to a first embodiment. FIG. 11 illustrates a coupling structure of the brush frame illustrated in FIG. 9 according to a second embodiment. FIG. 12 illustrates a coupling structure of the brush frame illustrated in FIG. 9 according to a third embodiment. FIG. 13 illustrates a coupling structure of the brush frame illustrated in FIG. 9 according to a fourth embodiment.

Referring to FIG. 10, the brush frame 721 is provided to be separated from the bottom of the inside of the main body 710 by a predetermined distance and the brush 720 is fixed to the brush frame 721. The at least one supporting units 722 protrude on the bottom of the main body 710.

The brush frame 721 is coupled onto the supporting units 722 in order to have the brush frame 721 provided to be separated from the bottom of the inside of the main body 710, that is, the bottom of a main body base 711 by a predetermined distance. As illustrated in FIG. 10, the brush frame 721 can be directly coupled onto the supporting units 722 by an adhesive agent or by welding.

When the brush frame 721 is provided on the supporting units 722, the foreign matters stored in the settling unit 713 of the main body 710 can move through spaces between the supporting units 722. Therefore, the foreign matters stored in the settling unit 713 of the main body 710 can be effectively discharged to the outside of the bush assembly 700 and the spaces in which the dust or the air can flow can be easily secured in the main body 710. As a result, the size of the cleaning device and the manufacturing cost of the cleaning device are reduced.

Referring to FIG. 10, when the brush frame 721 is provided on the supporting units 722, in order to effectively flow the foreign matters settled in the settling unit 71-3 between suctioning holes 714*a* on the partition 715, the ratio of the height H of the brush 720 to the height h of the supporting units 722 can be 0.1:1 to 0.6:1. In the range of the ratio, although the brush 720 contacts the filter 610 to be inclined, the foreign matters do not fall out of the brush assembly 700.

Referring to FIG. 11, the brush frame 721 can slide into the supporting units 722 to be coupled to the supporting units 722. Coupling protrusions 722*a* into which the brush frame 721 is fitted are formed on both sides of the supporting units 722 so that the brush frame 721 slides into the supporting units 722 to be coupled to the supporting units 722. The brush frame 721 is provided under the coupling protrusions 722*a* to slide into the supporting units 722 to be coupled to the supporting units 722.

In this case, when the life of the brush 720 ends, the brush 720 is released from the brush frame 721 so that the brush 720 can be easily exchanged with another.

Referring to FIG. 12, a coupling hook 721*a* can be formed on at least one side of the brush frame 721 and a hook recess 713*a* into which the coupling hook 721*a* is locked can be formed on one side of the main body 710. The hook recess 713*a* can be formed anywhere outside the main body and the coupling hook 721*a* can be locked into the hook recess 713*a*. In this case, when the life of the brush 720 ends, the coupling hook 721*a* is released from the hook recess 713*a* so that the brush can be easily exchanged with another one.

Referring to FIG. 13, both ends of the brush frame 721 can be fastened to both ends of the settling unit 713. That is, both ends of the brush frame 721 and both ends of the settling unit 713 are fastened by a predetermined fastening member 723. The fastening member 723 can be a fastening bolt or an adhesive agent, however, is not limited to the above.

In this case, since the brush frame 721 may not be provided on the supporting units 722, the structure of the supporting units 722 can be omitted. Both ends of the brush frame 721 are fastened to both ends of the settling unit 713 so that the brush frame 721 can be provided to be separated from the bottom of the inside of the main body 710, that is, the bottom of the settling unit 713 and that, when the foreign matters move from the settling unit 713 to the guiding unit 714 by the suction force of the suctioning unit 800, the formation of the resistance caused by the supporting units 722 can be prevented.

At least one reinforcing member 724 extended in the direction of the width of the main body 710 and fastened to the main body 710 can be formed on one side of the brush frame 721. Referring to FIG. 13, the reinforcing member 724 is extended from the side of the brush frame 721 in the direction of the width of the main body 710. The reinforcing unit 724 is fastened to the main body 710 through a predetermined fastening member 724*a*. The fastening member 724*a* can be a fastening bolt or an adhesive agent, however, is not limited to the above.

When the brush frame 721 is provided to be separated from the bottom of the inside of the main body 710 by a predetermined distance, load caused by the weight of the brush frame 721 is generated and the brush frame 721 can droop downward due to the load. In this case, the reinforcing member 724 formed on one side of the brush frame 721 supports the brush frame 721 in order to prevent the brush frame 721 from drooping downward. The number of reinforcing members 724 can be properly designed in consideration of the weight of the brush frame 721 and a contact area between the brush 720 and the filter 610.

Although the present invention has been described with reference to the embodiment shown in the drawings, these are merely illustrative, and those skilled in the art will understand that various modifications and equivalent other embodiments of the present invention are possible. Consequently, the true technical protective scope of the present invention must be determined based on the technical spirit of the appended claims.

What is claimed is:

1. A ceiling type air conditioner, comprising:

a case provided on a ceiling and in which a predetermined space is formed;

a base panel coupled to the case, wherein an air suctioning hole is formed on the base panel;

a filter provided in the air suctioning hole;

a filter housing in which the filter is settled;

a brush assembly comprising a brush that contacts foreign matters filtered by the filter and a main body that forms a predetermined space configured to collect and store the foreign matters that drop from the filter in a gravitational direction; and a moving unit configured to move the brush assembly from one side of the filter to the other side of the filter, the moving unit comprising:

a driving motor, and a power transmitting unit connected to the brush assembly to transmit a driving force of the driving motor to the brush assembly, wherein the moving unit comprises a wire belt for transmitting power to the brush assembly, wherein a wire connecting unit to which the wire belt is connected is formed on one side of the brush assembly, wherein movement guide units are coupled at both sides of the filter housing, and a plurality of rollers are installed at both sides of the main body of the brush assembly to roll while being guided by the movement guide units, and wherein the plurality of rollers comprises at least one horizontal roller which prevents the brush assembly from being released on at least one side of the filter housing in a front to rear direction of the brush assembly, and at least one vertical roller which prevents the brush assembly from being released on at least one side of the filter housing in an up to down direction of the brush assembly.

2. The ceiling type air conditioner of claim 1, wherein the movement guiding units comprise:

supporting surfaces extended downward from both ends parallel with the longitudinal direction of the filter housing to support both ends of the brush assembly in the longitudinal direction of the brush assembly; and separation preventing surfaces extended from the ends of the supporting surfaces to run parallel with the filter housing to prevent the brush assembly from being separated downward.

3. The ceiling type air conditioner of claim 2, wherein the at least one horizontal roller among the plurality of rollers is supported by the supporting surfaces to roll, and wherein the at least one vertical roller among the plurality of rollers is supported by the separation preventing surfaces to roll.

4. The ceiling type air conditioner of claim 1, wherein fixing units are formed in the wire connecting unit, wherein both ends of the wire belt are inserted and locked, and wherein the fixing units are hook-shaped.

5. A ceiling type air conditioner, comprising:

a case to be provided on a ceiling and in which a predetermined space is formed;

a base panel coupled to the case, wherein an air suctioning hole is formed on the base panel;

a filter provided in the air suctioning hole;

a filter housing in which the filter is settled;

a brush assembly comprising a brush that contacts foreign matters filtered by the filter and a main body that forms a predetermined space configured to collect and store the foreign matters that drop from the filter in a gravitational direction; and a moving unit configured to move the brush assembly from one side of the filter to the other side of the filter, the moving unit comprising: unit:

a driving motor, a power transmitting unit connected to the brush assembly to transmit a driving force of the driving motor to the brush assembly, wherein the power transmitting unit comprises a wire belt, and a plurality of rollers including at least one horizontal roller and at least one vertical roller, wherein the inside of the main body is partitioned off to form a settling unit in which the foreign matters that drop in the gravitational direction are to be settled and a guiding unit in which at least one suctioning hole is formed to guide the foreign matters settled in the settling unit to the outside of the main body through the at least one suctioning hole, wherein the brush assembly further comprises a brush frame to which brush is fixed upward, and a plurality of supporting units are formed on a bottom of the settling unit such that the brush frame is coupled to the supporting unit and placed to be separated from the bottom of the settling unit by a predetermined distance, wherein the supporting units are spaced each other such that a portion of the foreign matters settled in the settling unit move towards the guiding unit through spaces between the supporting units, and wherein coupling protrusions are formed on both sides of the supporting units such that the brush frame is inserted between the coupling protrusions.

6. The ceiling type air conditioner of claim 5, wherein a discharging hole is formed on one side of the guiding unit to discharge the foreign matters settled in the settling unit to the outside of the main body.

7. The ceiling type air conditioner of claim 5, wherein at least one partition for partitioning off between the settling unit and the guiding unit are formed in the main body, and wherein the at least one suctioning hole is formed between the at least one partition.

8. The ceiling type air conditioner of claim 7, wherein one end of the partition is rounded by a predetermined radius of curvature.

9. The ceiling type air conditioner of claim 5, wherein a width of the brush frame is smaller than a width of the settling unit.

10. The ceiling type air conditioner of claim 5, wherein both ends of the brush frame are fastened to both ends of the settling unit.

11. The ceiling type air conditioner of claim 9, wherein at least one reinforcing unit extended in a direction of the width of the main body to be fastened to the main body is formed on one side of the brush frame.

12. The ceiling type air conditioner of claim 1, wherein a coupling ring is formed on at least one side of the brush frame, and wherein a ring recess into which the coupling ring is locked is formed on one side of the main body.

13. A ceiling type air conditioner, comprising:

a case to be provided on a ceiling and in which a predetermined space is formed;

a base panel coupled to the case, wherein an air suctioning hole is formed on the base panel;

a filter provided in the air suctioning hole;

a filter housing in which the filter is settled;

a brush assembly comprising a brush that contacts foreign matters filtered by the filter and a main body that forms predetermined space configured to collect and store the foreign matters that drop form the filter in a gravitational direction; and a moving unit configured to move the brush assembly from one side of the filter to the other side of the filter, the moving unit comprising:

a driving motor, and a power transmitting unit connected to the brush assembly to transmit a driving force of the driving motor to the brush assembly, wherein the power transmitting unit includes:

a driving pulley connected to a rotary shaft of the driving motor, wherein the driving pulley is provided on one side of the filter housing;

a driven pulley provided on another side of the filter housing so as to be opposing the driving pulley;

a wire belt connected to the brush assembly to transmit the driving force of the driving motor to the brush assembly and wound around the driving pulley and the driven pulley;

a tension pulley provided on a traveling path of the wire belt to be separated from the driving pulley and the driven pulley so that the wire belt is wound on one side to generate tension in the wire belt, and a plurality of rollers including at least one horizontal roller and at least one vertical roller, wherein the main body includes:

a main body base configured to form a bottom of the main body on which the brush is installed, wherein the inside of the main body base is partitioned off to form a settling unit in which the foreign matters that drop in the gravitational direction are to be settled and a guiding unit which guides the foreign matters settled in the settling unit to the outside of the main body; and a main body cover configured to cover only the guiding unit, wherein the main body base and the main body cover are fitted into each other, and wherein the brush, the main body base, and the main body cover are placed beneath the filter.

* * * * *